United States Patent [19]

Suzuki

[11] Patent Number: 5,046,983

[45] Date of Patent: Sep. 10, 1991

[54] TOY HAVING ROTATABLE COVER AND PROTRUDING PIECES

[75] Inventor: Toshio Suzuki, Tokyo, Japan

[73] Assignee: K.K. Toy Box, Tokyo, Japan

[21] Appl. No.: 598,524

[22] Filed: Oct. 16, 1990

[30] Foreign Application Priority Data

Dec. 11, 1989 [JP] Japan ..... 1-319037

[51] Int. Cl.[5] ..... A63H 23/10; A63H 13/00

[52] U.S. Cl. ..... 446/158; 446/236; 446/356; 446/368

[58] Field of Search ..... 446/356, 353, 352, 368, 446/298, 300, 308, 156, 158, 236, 238, 241

[56] References Cited

U.S. PATENT DOCUMENTS 2,329,564 9/1943 Thomas ..... 446/356 X
4,236,346 12/1980 Iwao ..... 446/368 X
4,261,136 4/1981 Tsui ..... 446/238
4,301,615 11/1981 Ikeda ..... 446/356 X

FOREIGN PATENT DOCUMENTS 2029248 3/1980 United Kingdom .
2037172 7/1980 United Kingdom .

*Primary Examiner*—Mickey Yu
*Attorney, Agent, or Firm*—Sughrue, Mion, Zinn, Macpeak & Seas

[57] ABSTRACT

A motorized toy incorporating a drive source and moving while performing a series of predetermined repetitive motions, includes a plurality of protruding pieces extending from an interior of a body to the outside thereof, passing through notches cut in the peripheral portions of a cover member. The body incorporates main and auxiliary shafts, each rotating by receiving, via gears, transmission of a driving force from the drive source. The protruding pieces are automatically housed in the cover member, as they interlock with rotation of the main shaft. Rotation of the auxiliary shaft is transferred to the cover member via levers actuated during the period that the protruding pieces are housed within the cover member, and the cover member makes a predetermined number of revolutions. Upon completion of the rotation of the cover member, the protruding pieces housed therein spring out of the body. These operations are continually repeated.

20 Claims, 4 Drawing Sheets

TOY HAVING ROTATABLE COVER AND PROTRUDING PIECES

BACKGROUND OF THE INVENTION

The present invention relates to a motorized toy, and more particularly, to a toy which moves over a surface while performing predetermined repetitive operations in such a manner that a plurality of components of the body of the motorized toy are moved synchronously with one another.

A primary object of the present invention is to provide a toy which moves over a surface while continually repeating new patterns of motions in such a manner that the motions of a plurality of parts of the body of the toy are synchronized with one another.

SUMMARY OF THE INVENTION

According to the present invention, there is provided a motorized toy comprising: a body incorporating a drive source, a propelling unit driven by the drive source, a main shaft rotated by receiving transmission of the driving force from the drive source via gears and an auxiliary shaft; a cover member formed with a plurality of notches in its outer periphery and mounted above the body of the toy: and protruding pieces, which are inserted into the notches of the cover member, to which elastic forces acting in outer directions of the body are imparted, wherein the protruding pieces are accommodated in the interior of the cover member while interlocking with rotations of the main shaft, rotation of the auxiliary shaft is transferred to the cover member via a lever actuated during an accommodating period of the protruding pieces in the cover member to cause a predetermined number of revolutions of the cover member, and the protruding pieces revert to their initial protruding state by being released from the accommodating state after the cover member has finished rotating.

The drive source employed in the present invention preferably may be implemented with an electric motor, but the motive power may also be generated by a spiral spring. The propelling unit may be designed for traveling on land (or a suitably firm surface) by using wheels, and/or designed for traveling on a water surface by using a screw (propeller). Thus, the propelling unit may be designed as an amphibian device.

BRIEF DESCRIPTION OF THE DRAWINGS

The above and other objects, features, and advantages of the invention will become more apparent from the following detailed description when read in conjunction with the accompanying drawings in which.

DESCRIPTION OF THE PREFERRED EMBODIMENTS

A preferred embodiment of the present invention and the operation thereof will be described hereinafter with reference to the accompanying drawings. In this embodiment, for example, the invention is designed for travel on a water surface.

Figure 1:
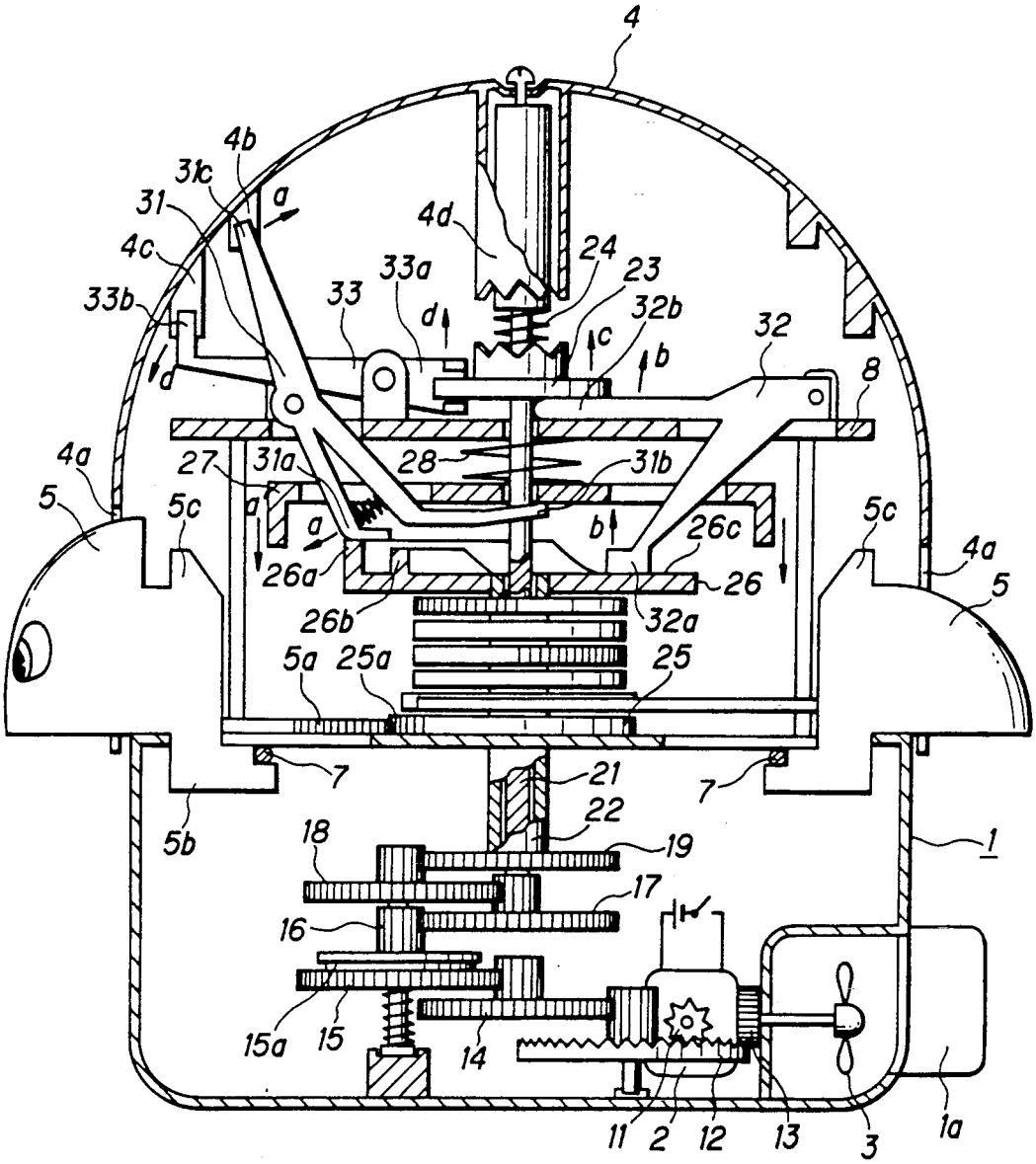
FIG. 1 is a vertical sectional view illustrating the structure of one embodiment of a motorized toy according to the present invention.

As shown in FIG. 1, a plastic body 1 incorporates a drive source 2 (motor), the rotation thereof being transferred via gears 11, 12, and 13 to a propelling unit 3 (screw propeller) to propel the toy. The rotation of the drive source 2 is conveyed via gears 11. 12, 14, 15, and 16 to a gear 17 having an auxiliary shaft 21 fixed thereto. A plate clutch 15*a* is fixed to gear 15. The auxiliary shaft 21 is inserted into a main shaft 22 which rotates when receiving power transmission via gears 18 and 19, thereby rotating the auxiliary shaft 21 at a greater number of revolutions than that of the main shaft 22. An engagement piece 23 is attached to an upper portion of the auxiliary shaft 21 via a spring 24. The engagement piece 23 slides up and down, so as to transfer the rotation of the auxiliary shaft 21 to the cover member 4.

Figure 2:
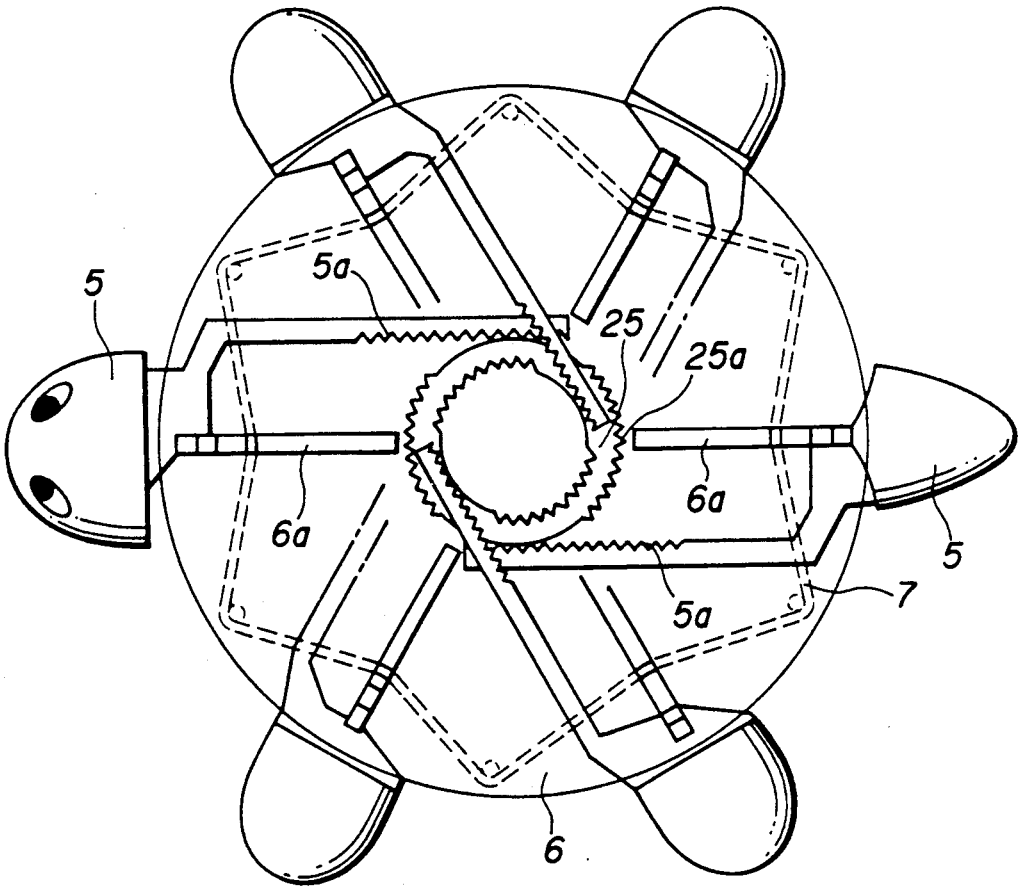
FIG. 2 is a plan view depicting an accommodating mechanism for protruding pieces.
Figure 3:
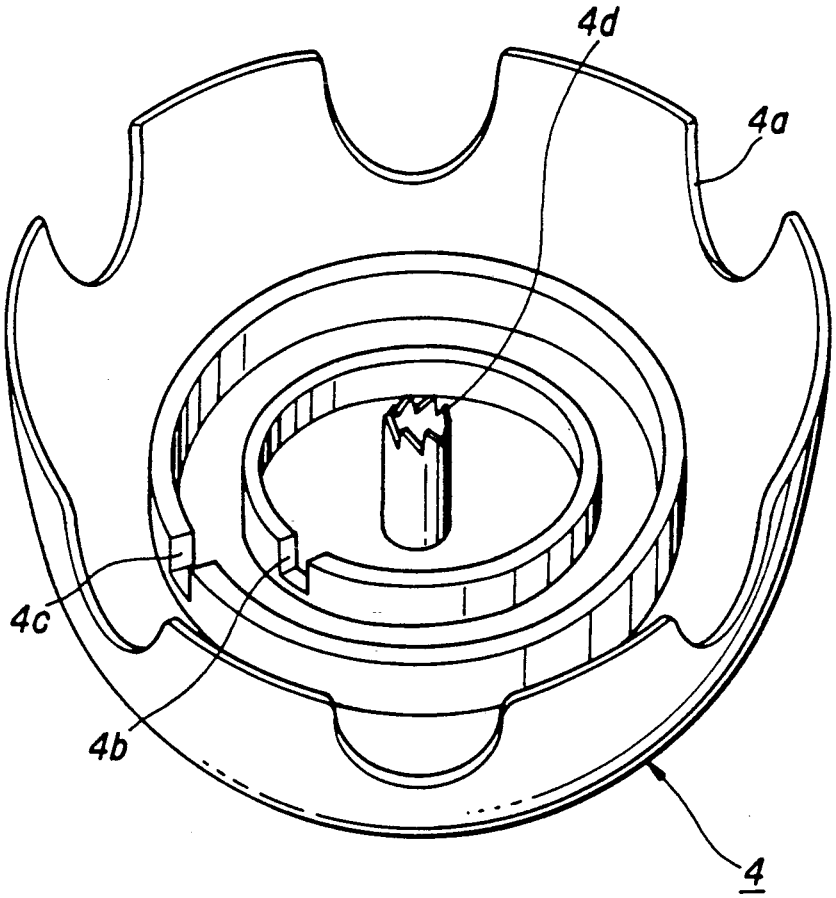
FIG. 3 is a perspective view showing the interior of cover member.
Figure 4:
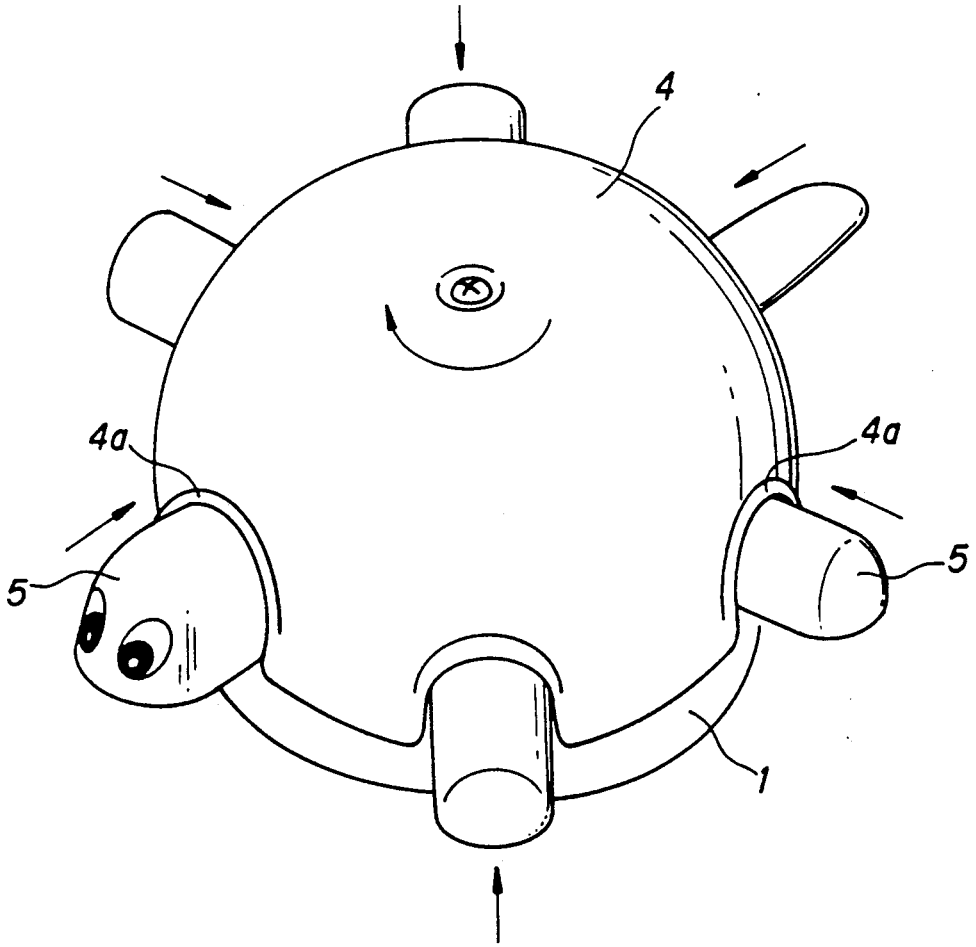
FIG. 4 is a perspective view depicting the device in its entirety. (As depicted in FIG. 4, the device is formed to assume a turtle-like configuration, including a carapace, a head, a tail, and legs.)

Retract disk 25, which is composed of six layers, houses protruding pieces 5 in cover member 4. Each of the layers of the retract disk 25 are fixed to the main shaft 22. As illustrated in FIG. 2, the retract disk 25 includes a gear 25*a* formed on part of its periphery. Upon rotation, the retract disk 25 engages a rectilinear gear part 5*a* extending from each protruding piece 5, and retracts the protruding piece 5 into the cover member 4.

Fitting parts 5*b* of the protruding pieces 5 are fitted in slide grooves 6*a*, formed in a partition plate 6 in the radial directions thereof, whereby the protruding pieces 5 slidably reciprocate in the radial direction of the partition plate. The protruding pieces 5 also engage ring-like elastic members 7, thus imparting elastic forces in an outward direction relative to the body 1.

A disk 26 is fixed to the main shaft 22 above the retract disk 25, and includes protrusions 26*a* and 26*b* formed on inner and outer peripheries thereof so as to partly protrude in the peripheral direction. The disk 26 rotates together with the main shaft 22.

A first lever 31, a second lever 32, and a third lever 33 are rotatably attached to a board 8 disposed above the disk 26. A stopper plate 27 is accommodated in a space defined by a lower part of the first lever 31 and by the board 8 such that the stopper plate 27 is pushed downwardly by a spring 28. The stopper plate 27 stops the protruding piece 5 by engaging a stopping portion 5*c* formed on the protruding piece 5 when housing the protruding piece 5. One end of the first lever 31 is formed by two parts 31*a*, 31*b* with a fulcrum being substantially positioned therebetween. One end part 31*a* is placed on the protrusion 26*a* partly projecting from the outer periphery of the disk 26, while a second end part 31*b* impinges on the stopper plate 27 from below. The other end 31*c* of the first lever 31, having the fulcrum substantially positioned therebetween, engages a notch 4*b* cut in an inner portion of the cover member 4.

The second lever 32 is formed by two parts 32*a*, 32*b* emanating from its fulcrum. Specifically, a lower end part 32*a* is placed on the protrusion 26*b* partly projecting from the inner periphery of the disk 26, while an upper end part 32*b* is inserted between the board 8 and the engagement piece 23.

The third lever 33 has an end part 33*a* which engages the engagement piece 23, while another end part 33*b* engages a notch 4*c* cut in an inner portion of the cover member 4.

In the embodiment shown in FIG. 1, the interior of the cover member 4 has a buoyancy imparting material such as a foamed styrene. A rudder 1*a* for steering is provided at a rear part of the body 1, and is used to determine a course of travel of the toy on the water surface and to prevent the body 1 from rotating. The operation of the above-described embodiment will be described hereinbelow. Referring to FIG. 1, when actuating the drive source 2, the propelling unit 3 (screw) is driven, and simultaneously the main shaft 22 and the auxiliary shaft 21 begin rotating In this state, the rotary motion of the engagement piece 23 fitted to the auxiliary shaft 21 is not immediately transferred to the cover member 4, and therefore the cover member 4 remains static. When the main shaft 22 continues to rotate further, the gear 25*a* of the retract disk 25 which rotates concomitantly therewith meshes with the gear part 5*a* of the protruding piece 5, resulting in the protruding piece 5 being gradually accommodated in the cover member 4. When the protruding piece 5 is completely housed in the interior of the cover member 4, the end part 31*a* of the first lever 31 shifts to a flat portion 26*c* from the upper portion of the protrusion 26*a* due to the rotation of the disk 26. As a result, the first lever 31 moves in the direction of arrow a shown in FIG. 1. The other end part 31*c* of the first lever 31 disengages from the notch 4*b* of the cover member 4, and simultaneously the stopper plate 27 is thrust downwardly by the spring 28 to move in the direction of arrow a shown in FIG. 1.

Subsequently, the stopper plate 27 engages the stopping portion 5*c* of the protruding piece 5, thus maintaining the accommodating state of the protruding piece 5 within cover member 4. Almost concurrently with this step, the lower end part 32*a* of the second lever 32 shifts from the flat portion 26*c* of the disk 26 to the protrusion 26*b* partly projecting from the inner periphery of the disk 26, and the lower end part 32*a* moves in the direction of arrow b shown in FIG. 1.

As a result, the engagement piece 23 slides upwards (in the direction of arrow shown in FIG. 1, while rotating with the auxiliary shaft 21, and engages (meshes) an engagement portion 4*d* formed in the interior of the cover member 4. Consequently, the cover member 4 start rotating after receiving the rotational force of the auxiliary shaft 21. At this time, the upward movement of the engagement piece 23 causes an end part 33*a* of the third lever 33 to move in the direction of arrow shown in FIG. 1, and he other end part 33*b* of the third lever 33 to disengage from he notch 4*c* formed in the interior of the cover member 4.

After the cover member 4 has rotated a predetermined number of times, the lower end part 32*a* of the second lever 32 shifts to the flat portion 26*c* from the protrusion 26*b* partly projecting from the inner periphery of the disk 26 (the state shown in FIG. 1). Concomitantly, the engagement piece 23 slides downwardly and disengages from the cover member 4, and as a result the rotation of the auxiliary shaft 21 is not transferred to the cover member 4. Furthermore, the third lever 33 also moves. Hence, the end part 33*b* of the third lever engages the notch 4*c* formed in the interior of the cover member 4 completely stopping the rotation of the cover member 4 (as shown in the state of FIG. 1).

Almost concurrently with this motion, one end part 31*a* of the first leVer 31 shifts from the flat portion 26*c* to the protrusion 26*a* partly protruding from the outer periphery of the disk 26 by the rotational force of the disk 26 (as shown in the state of FIG. 1). As a result, the stopper plate 27 also is forced to move upwardly, thereby disengaging from the stopping portion 5*c* of the protruding piece The protruding piece 5, to which elastic forces acting in the outer direction of the body are imparted from the ring-like elastic member 7, passes through the notch 4*a* of the cover member 4 and springs out of the body when the engagement is released. Thus, an operation is completed. This operation is thereafter continually repeated.

The motorized toy of the present invention has been described in detail by way of the aforementioned exemplary embodiment. The present invention is not, however, limited to this embodiment. A variety of modifications or changes may be practicable within a range which does not depart from the scope of the invention. For instance, the exterior design is not confined to animal-like designs such as a turtle or the like, but the exterior design may take a variety of forms. According to the embodiment discussed above, the min and auxiliary shafts are constructed separately to rotate through different numbers of revolutions. However, the main and auxiliary shafts may be formed as a single shaft to undergo the same number of revolutions. Additionally, the number of revolutions of the cover member 4 during the operation need not necessarily be an integer value. For example, if six protruded pieces are disposed (each separated by 60° about the rotary shaft), the number of revolutions may be set to 1 1/6. The configurations of the levers may also be modified.

According to the motorized toy of the present invention, the protruding pieces are automatically housed in the cover member, and thereafter the cover member makes a predetermined number of revolutions. After the predetermined number of revolutions has been completed, the protruding pieces housed therein spring out. The toy continues to travel while repetitively performing a series of motions not found in conventional systems. The toy incorporating these motions provides an interesting children's toy.

While certain preferred embodiments have been shown and described, many changes and modifications within the spirit of the invention will be apparent to those of working skill in this technical field. Thus, the scope of the invention should be considered as limited only by the appended claims.

What is claimed is:

1. A motorized toy comprising:

a body incorporating a drive source, a propelling unit driven by said drive source, a main shaft rotated by receiving transmission of driving force from said drive source via gears, and an auxiliary shaft;

a cover member formed with a plurality of notches in its outer periphery and mounted above said body;

protruding pieces, inserted into said notches of said cover member, having imparted thereon elastic forces acting in outer directions of said body; and means for holding and releasing said protruding pieces from said cover;

wherein said protruding pieces are accommodated in the interior of said cover member by interlocking with rotation of said main shaft, and wherein rotation of said auxiliary shaft is transferred to said cover member through a lever, during a period in which said protruding pieces are accommodated within said cover member, to cause said cover member to rotate a predetermined number of times, and said protruding pieces revert to an initial protruding state by releasing said protruding pieces from being accommodated within said cover member after said cover member has finished rotating said predetermined number of times.

2. A motorized toy as defined in claim 1, wherein said drive source comprises an electric motor.

3. A motorized toy as defined in claim, wherein said drive source comprises a spiral spring.

4. A motorized toy as defined in claim 1, wherein said propelling unit comprises a screw propeller.

5. A motorized toy as defined in claim 1, further comprising ring-like elastic members engaging said protruding pieces and imparting said elastic forces on said protruding pieces.

6. A motorized toy as defined in claim, wherein said lever has a first end placed on a disk and a second end inserted between a board and an engagement piece.

7. A motorized toy as defined in claim 4, wherein the interior of said cover member includes a buoyancy imparting material.

8. A motorized toy as defined in claim 7, wherein said buoyancy imparting material comprises foamed styrene.

9. A motorized toy as defined in claim 1, wherein said main shaft and said auxiliary shaft are formed into a single shaft having the same number of revolutions.

10. A motorized toy as defined in claim 1, wherein said protruding pieces each have a gear part extending therefrom.

11. A motorized toy comprising:

a body having a drive source, said drive source including gears;

a propelling unit driven by said drive source;

a main shaft and an auxiliary shaft, said main shaft and said auxiliary shaft being rotated by said drive source;

a cover member having a plurality of notches and being mounted on said body;

protruding pieces inserted into said notches and coupled to said main shaft, and accommodated within said cover member by rotation of said main shaft; and a lever connected to said auxiliary shaft and said cover member;

wherein rotation of said auxiliary shaft is transferred to said cover member and wherein said protruding pieces protrude from said cover member after said cover member has finished rotating a predetermined number of times.

12. A motorized toy as defined in claim 11, wherein said drive source comprises an electric motor.

13. A motorized toy as defined in claim 11, wherein said drive source comprises a spiral spring.

14. A motorized toy as defined in claim 11, wherein said propelling unit comprises a screw propeller.

15. A motorized toy as defined in claim 11, further comprising ring-like elastic members engaging said protruding pieces and imparting elastic forces thereon in an outer direction of said body.

16. A motorized toy as defined in claim 11, wherein said lever has a first end placed on a disk and a second end inserted between a board and an engagement piece.

17. A motorized toy as defined in claim 11, wherein the interior of said cover member includes a buoyancy imparting material.

18. A motorized toy as defined in claim 17, wherein said buoyancy imparting material comprises foamed styrene.

19. A motorized toy as defined in claim 11, wherein said main shaft and said auxiliary shaft are formed into a single shaft having the same number of revolutions.

20. A motorized toy as defined in claim 11, wherein said protruding pieces each have a gear part extending therefrom.

* * * * *